United States Patent [19]

Szklany et al.

[11] Patent Number: 5,023,600

[45] Date of Patent: Jun. 11, 1991

[54] ELECTRONIC ARTICLE SURVEILLANCE SYSTEM WITH ADAPTIVENESS FOR SYNCHRONIZATION WITH COMPANION SYSTEMS

[75] Inventors: Craig R. Szklany, Boynton Beach; Frank Drucker, Tamarac, both of Fla.

[73] Assignee: Sensormatic Electronics Corporation, Deerfield Beach, Fla.

[21] Appl. No.: 507,619

[22] Filed: Apr. 10, 1990

[51] Int. Cl.[5] ..... G08B 13/14

[52] U.S. Cl. ..... 340/572; 340/825.14

[58] Field of Search ..... 340/572, 825.2, 825.14, 340/309.15; 375/106-107; 370/100.1

[56] References Cited

U.S. PATENT DOCUMENTS

| | | | |
|---|---|---|---|
| 4,667,185 | 5/1987 | Nourse et al. | 340/572 |
| 4,686,513 | 8/1987 | Farrar et al. | 340/572 |
| 4,797,659 | 1/1989 | Larsen | 340/572 |
| 4,851,815 | 7/1989 | Enkelmann | 340/572 X |

*Primary Examiner*—Glen R. Swann, III
*Assistant Examiner*—Thomas J. Mullen, Jr.
*Attorney, Agent, or Firm*—Robin, Blecker, Daley & Driscoll

[57] ABSTRACT

The invention provides in combination, an electronic article surveillance system for disposition in an area to be subjected to such surveillance and control circuitry connected with the system, the system generating a readiness signal when prepared to effect electronic article surveillance and being thereafter responsive to an input signal to commence electronic article surveillance, the control circuitry being responsive to the readiness signal selectively to generate the input signal and being adapted to suppress generation of the input signal responsively to further input to the control circuitry indicative of the existence of a predetermined condition. The predetermined condition is the presence in the area of a further electronic surveillance system which has not generated its readiness signal, and the invention looks to interconnecting the further system to the control circuitry.

8 Claims, 4 Drawing Sheets

ELECTRONIC ARTICLE SURVEILLANCE SYSTEM WITH ADAPTIVENESS FOR SYNCHRONIZATION WITH COMPANION SYSTEMS

FIELD OF THE INVENTION

This invention relates generally to electronic article surveillance (EAS) systems and more particularly to the synchronization of multiple stations for communicating with EAS tags of the so-called "active" type.

BACKGROUND OF THE INVENTION

In EAS systems, significant advantages are obtained using an "active" tag as opposed to the traditional "passive" tag. The "active" tags each include a receiver unit for receiving signals and decoding messages therein, an alarm unit and a signal processor to decode messages for selectively operating the alarm unit to provide sensible output alarm indication. Such "active" tag is disclosed in U.S. Pat. No. 4,686,513 which is incorporated herein by this reference thereto.

The '513 patent describes an application in which multiple transmitters, each transmitting within a confined area, communicate with "active" tags within their boundaries. For example, in a store, a first transmitter may be stationed at the exit area, thereby providing a protected exit area. A tag brought without authorization into the exit are will be interrogated and an appropriate alarm will be initiated. A second transmitter is provided at the checkout counter, therebY providing a protected checkout area. A tag within the checkout area can be instructed to assume a variety of operating states. For example, the tag can be caused to issue an alarm output to prompt checkout clerk removal thereof from a purchased article. Further, the tag can be placed in a "sleep" state, accordingly to pass through the exit area in authorized manner if not removed from the article.

Large installations typically involve a substantially-sized controlled surveillance area and accordingly may require plural active transmitters in addition to the exit and checkout transmitters, which may themselves be in pluralities.

Of primary concern in increasing the number of transmitters is the amount of interference between transmitters which may be mutually unsynchronized. Interference reduces the sensitivity of the system and degrades the performance thereof. Increasing the distance between the unsynchronized transmitters decreases the interference. However, a significant loss in flexibility of installation results when spacing between transmitters is required.

Another consideration of applicants is in addressing generally the synchronizing of a plurality of signal transmission systems. It is typical in prior art signal transmission systems that one identifies a "master" among the plurality of participating systems and identifies all other participating systems as "slaves". The shortcoming of such prior art arrangement is that the overall network is at the mercy of the identified master system continuing operationally and maintaining synchronization of the network. Thus, where the master system becomes inoperative after synchronization, the network fails at large as respects synchronous transmissions.

SUMMARY OF THE INVENTION

The present invention has as its primary object the providing of improved EAS systems.

A more particular object of the invention is the provision of an EAS system having enhanced capacity for synchronization in respect of other such EAS systems.

A specific object of the invention is the reduction of interference between and among multiple EAS systems.

A general object of the invention is the continuation of a transmission synchronization among a plurality of participating stations wherein the debilitation of a master station is not of consequence to the continuance of synchronous operation among stations surviving the demise of the master station.

In attaining the foregoing and other objects, the present invention provides, in combination, an electronic article surveillance system for disposition in an area to be subjected to such surveillance and control circuitry connected with the system, the system generating a readiness signal when prepared to effect electronic article surveillance and being thereafter responsive to an input signal to commence electronic article surveillance, the control circuitry being responsive to the readiness signal selectively to generate the input signal and being adapted to suppress generation of the input signal responsively to further input to the control circuitry indicative of the existence of a predetermined condition.

In the preferred embodiment and practice in accordance with the invention, the predetermined condition is the presence in the area of a further electronic article surveillance system which has not generated its readiness signal, and the invention looks to circuitry interconnecting the further system to the control circuitry.

In its overall sense, the invention provides, in combination, for effecting electronic article surveillance in an area:

(a) a first electronic article surveillance system for disposition in the area and first control circuitry connected with the first system, the first system generating a readiness signal when prepared to effect electronic article surveillance and being thereafter responsive to a first input signal to commence electronic article surveillance; and (b) a second electronic article surveillance system for disposition in the area and second control circuitry connected with the second system, the second system generating a readiness signal when prepared to effect electronic article surveillance and being thereafter responsive to a second input signal to commence electronic article surveillance, the first and second control circuitry being interconnected and operative respectively to simultaneously generate the first and second input signals selectively upon generation of both of the readiness signals and to suppress generation of both of the first and second input signals absent the generation of both of the readiness signals.

With respect to the master/slave situation, the invention provides a method for synchronizing signal transmissions by a plurality of participating signal transmission systems, each adapted to generate a readiness signal when prepared to transmit signals, the method including the steps of:

(a) accepting, as a master signal transmission system, the participating signal transmission system which happens to generate its readiness signal at a point in time after the generation of readiness signals by all others of the participating signal transmission systems;

(b) synchronizing signal transmissions by all of the participating systems responsively to generating of the readiness signal by the accepted master signal transmission system; and (c) effecting continuance of the synchronism between remaining of the systems despite inoperativeness, subsequently to such effecting of synchronous signal transmission, of the accepted master signal transmission system.

In implementing such method for synchronizing, the invention provides, in combination:

(a) a plurality of signal transmission systems in number n (n being an integer exceeding two), the systems generating respective system readiness signals when prepared to transmit signals; and (b) control circuitry connected with the systems for effecting synchronous signal transmission by the systems upon the occurrence of the last to be generated of the system readiness signals and for effecting continuance of the synchronism between remaining of the systems despite inoperativeness, subsequently to such effecting of synchronous signal transmission, of the system generating the last to be generated of the system readiness signals.

The foregoing and other objects and features of the invention will be further understood from the following detailed description of preferred embodiments thereof and from the drawings wherein like reference numerals identify like components and parts throughout.

DESCRIPTION OF THE PREFERRED EMBODIMENTS AND PRACTICES

Figure 1:
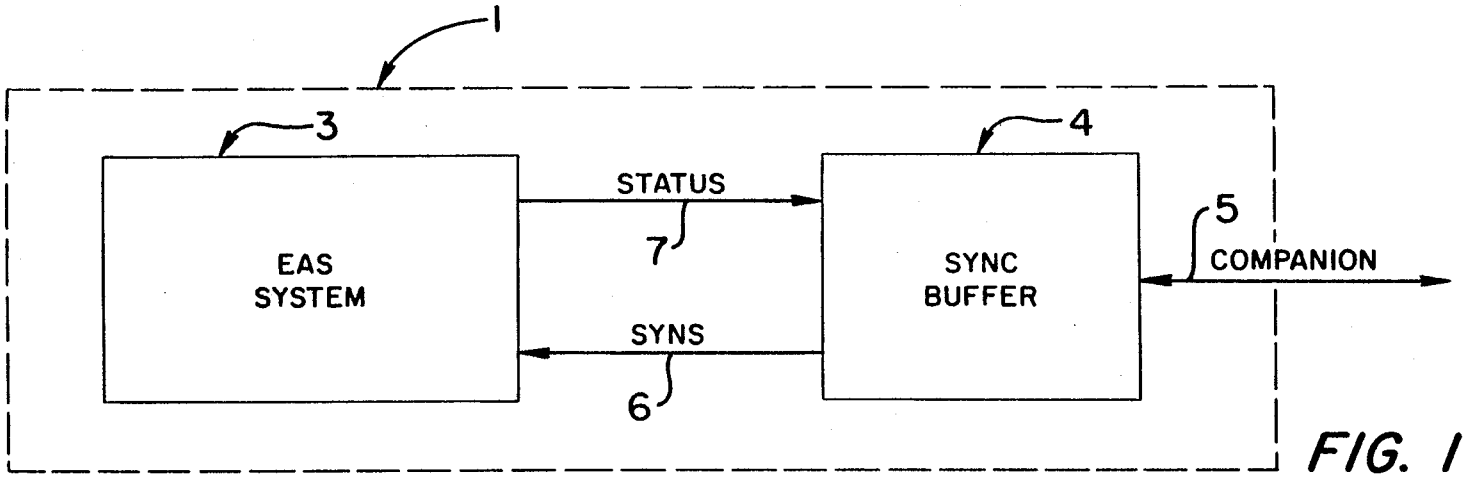
FIG. 1 is a block diagram of an individual EAS system configured in accordance with the invention.

Referring to FIG. 1, EAS sYstem 3, which may be configured in accordance with the incorporated '513 patent, includes connection lines 6 (SYNC) and 7 (STATUS) connected therefrom respectively to the synchronization output and status input of synchronization buffer 4. The EAS system 3 includes apparatus for transmitting messages within a bounded area 1 to "active" type EAS tags within the bounded area 1 as covered in full in the incorporated '513 patent. The FIG. 1 apparatus further includes a line 5 (COMPANION), the consequence of which is below discussed.

Figure 2:
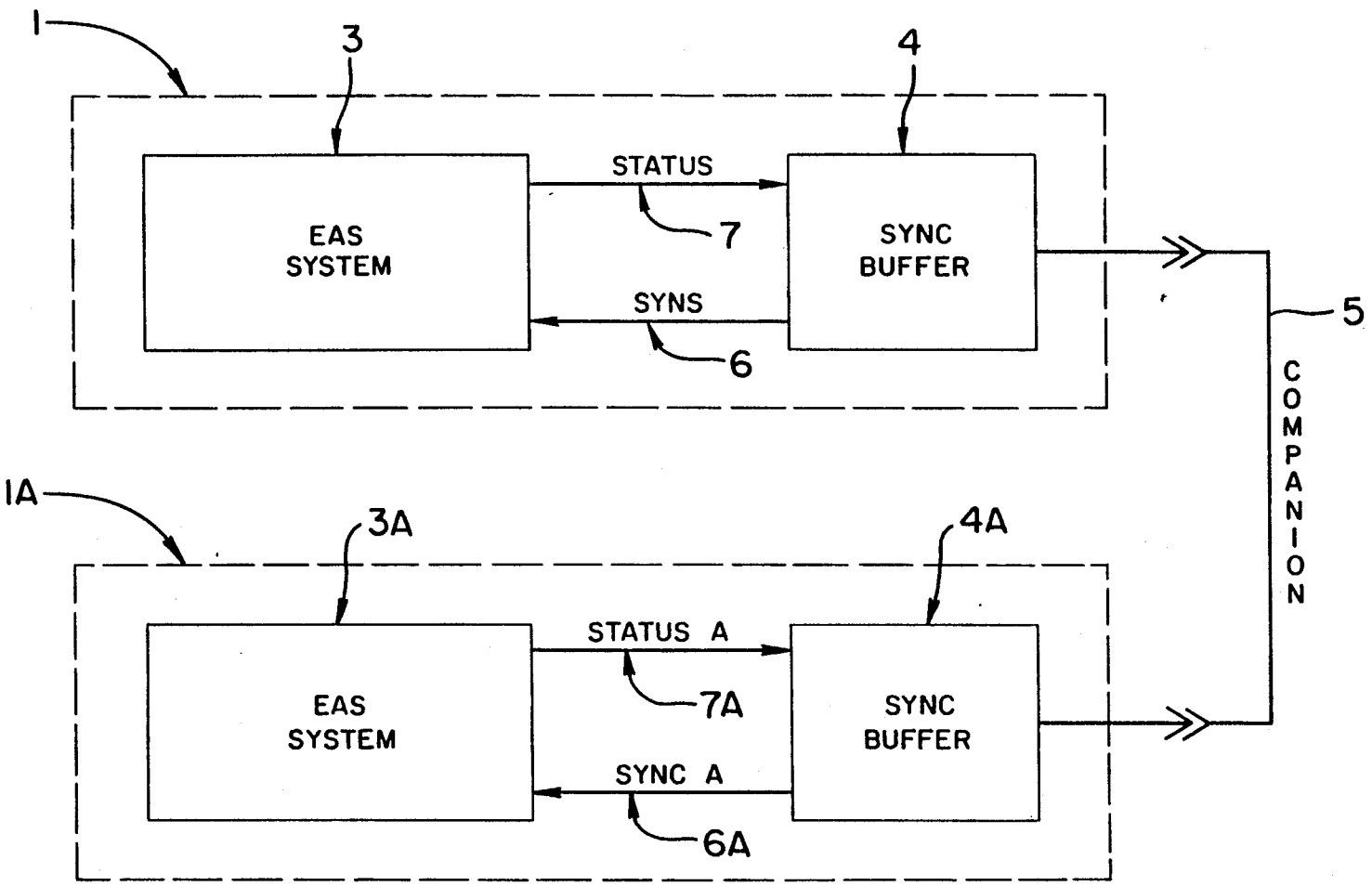
FIG. 2 is a block diagram of multiple EAS systems configured in accordance with the invention.

Turning to FIG. 2, second EAS system 3A, which may also be configured in accordance with the incorporated '513 patent, includes connection lines 6A (SYNC) and 7A (STATUS) connected therefrom respectively to the synchronization output and the status input of synchronization buffer 4A. The EAS system 3A includes apparatus for transmitting messages within a bounded area 1A to "active" type EAS tags within the bounded area 1A. COMPANION line 5 connects sync buffer 4 with sync buffer 4A.

Figure 3:
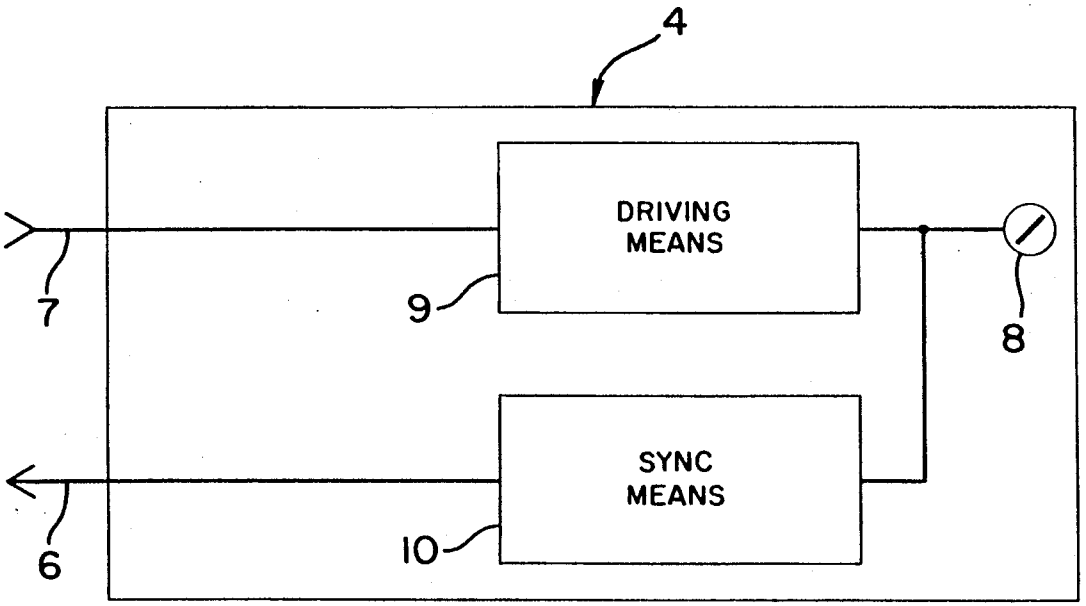
FIG. 3 is a block diagram of a single synchronization buffer in accordance with the invention.

FIG. 3 is a block diagram of sync buffer 4 of FIG. 1 (and sync buffer 4A of FIG. 2). A bidirectional input/output (I/O) terminal 8 connects through a synchronization unit 10 for supplying a synchronization signal to line 6. Line 7 connects through driver 9 to terminal 8. Line 7 receives an active logic signal when the EAS system is in readiness to commence transmitting and an inactive signal when not so prepared. Driver 9 drives terminal 8 to a first logic level when line 7 receives the active logic signal and drives terminal 8 to a second logic level when line 7 receives the inactive logic signal. Synchronization unit 10 provides a sync output on line 6 when terminal 8 is at the first logic level.

Figure 4:
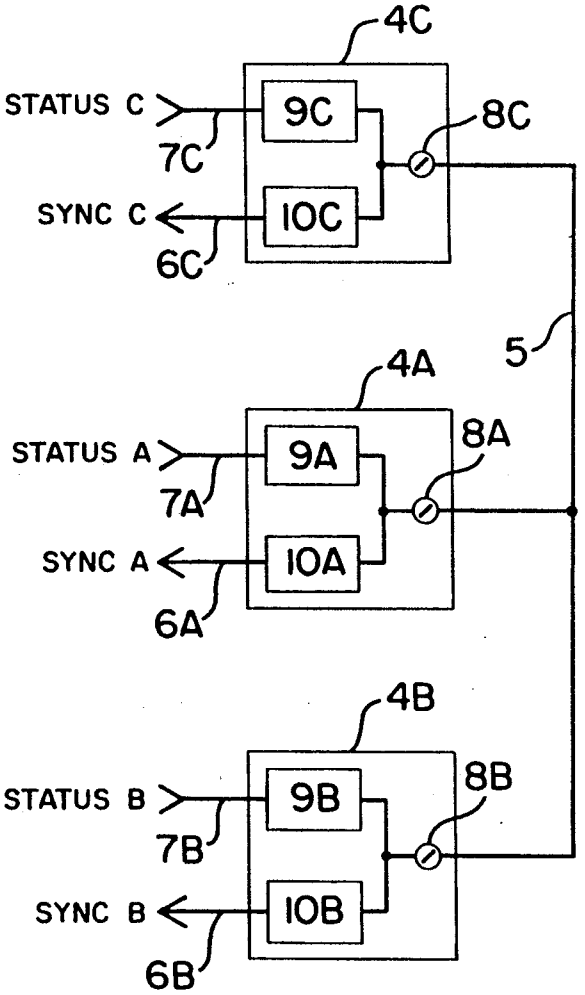
FIG. 4 is a block diagram of multiple synchronization buffers connected together in accordance with the invention.

Referring to FIG. 4, three sync buffers 4A, 4B and 4C are shown. Each sync buffer is configured as in the case of that shown in FIG. 3. Companion line 5 connects terminals 8A, 8B and 8C together.

Figure 5:
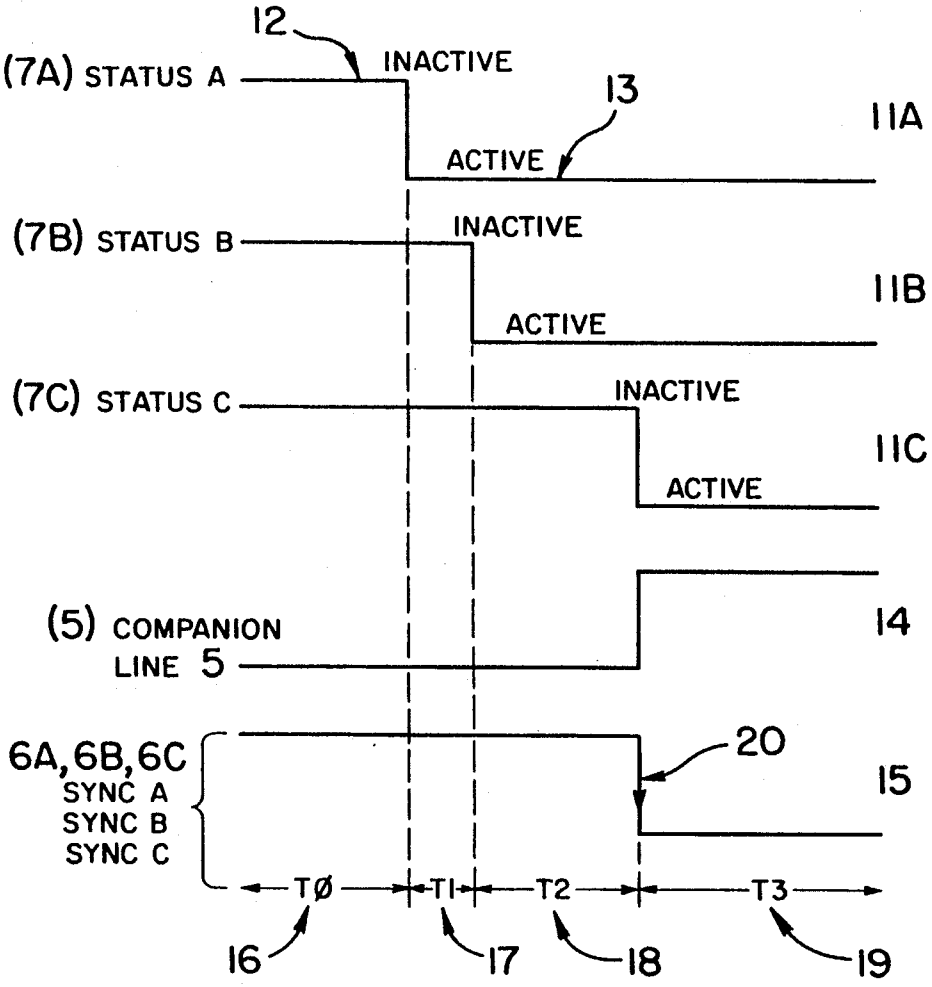
FIG. 5 is timing diagram depicting the initial synchronization sequence of the elements of FIG. 4.

FIG. 5 is a timing diagram depicting the initial synchronization sequence of the sync buffers shown in FIG. 4. The states of the status inputs 7A, 7B and 7C are represented by waveform diagrams 11A, 11B and 11C accordingly. A high logic level 12 represents an inactive status input and a low logic level 13 represents an active status input. The logic state of the companion line 5 is represented by waveform 14 and sync outputs 6A–6C are represented by waveform 15. The sync waveform 15 is the inverse of waveform 14. A falling edge 20 (transition edge from high to low) in waveform 15 is the synchronization trigger for the EAS systems. At time T0 16, the states of the status inputs 7A–7C are all inactive and companion line 5 is low. At T1 17, the state of status line 7A becomes active. However, there is no change to the state of the sync line 6A. At T2 18, the state of status line 7B becomes active. However there is no change in the state of the sync line 6B. At T3 19, the remaining status line 7C changes to an active state and the state of companion line 14 changes from low to high. Consequently, at the beginning of T3 19, the sync waveform 15 changes from a high state to a low state thereby generating a falling edge 20 which the EAS systems use as their synchronization trigger.

As will be seen from the foregoing, the present invention provides, in combination, and by way of summary, an electronic article surveillance system for disposition in an area to be subjected to such surveillance and control circuitry (sync buffer 4) connected with the system, the system generating a readiness signal (the STATUS signal on line 7) when prepared to effect electronic article surveillance and being thereafter responsive to an input signal (the SYNC signal on line 6) to commence electronic article surveillance, the control circuitry being responsive to the readiness signal selectively to generate the input signal and being adapted to suppress generation of the input signal responsively to further input to the control circuitry indicative of the existence of a predetermined condition. In the preferred embodiment and practice, the predetermined condition is the presence in the area of a further electronic surveillance system which has not generated its readiness signal, and the invention looks to circuitry interconnecting the further system to the control circuitry.

As will be further seen, in its overall sense, the invention provides, in combination, for effecting electronic article surveillance in an area a first electronic article surveillance system for disposition in the area and first control circuitry connected with the first system, the first system generating a readiness signal when prepared to effect electronic article surveillance and being thereafter responsive to a first input signal to commence electronic article surveillance and a second electronic article surveillance system for disposition in the area and second control circuitry connected with the second system, the second system generating a readiness signal when prepared to effect electronic article surveillance and being thereafter responsive to a second input signal to commence electronic article surveillance, the first and second control circuitry being interconnected and operative respectively to simultaneously generate the first and second input signals selectively upon generation of both of the readiness signals and to suppress generation of both of the first and second input signals absent the generation of both of the readiness signals.

As will be appreciated, apparatus of the invention may comprise a single EAS system with the described control circuitry which is thereby adapted for communal participating with companion EAS systems likewise configured, should the companion systems be added at a time subsequent to the installation of a single EAS system.

Once companion systems are synchronized per the invention, the removal of one or more of the systems will not affect the operation of the remaining systems. Therefore, for example, disability of any system in the overall network of systems will not affect any other systems. Evidently, the order in which the systems power up is not of consequence.

To the extent that the last system to generate its readiness signal may be considered as a "master" station, since it effects synchronization of itself with systems earlier generating readiness signals, which may then be considered as "slave" stations, the systems will each be seen as having both master and slave potential. Also, in contrast to known synchronization of participating systems, operational failure of the system which happened to act as the master will not impact on the synchronization, since the control circuitry is effective to continue synchronization, once set, by ignoring such subsequent event.

More particularly, the invention provides in combination in this last-mentioned aspect a plurality of signal transmission systems in number n (n being an integer exceeding two), the systems generating respective system readiness signals when prepared to transmit signals, and control circuitry connected with the systems for effecting synchronous signal transmission by the systems upon the occurrence of the last to be generated of the system readiness signals and for effecting continuance of the synchronism between remaining of the systems despite inoperativeness, subsequently to such effecting of synchronous signal transmission, of the system generating the last to be generated of the system readiness signals.

Also, in the last-mentioned aspect, the invention will be appreciated as defining a method for synchronizing signal transmissions by a plurality of participating signal transmission systems, each adapted to generate a readiness signal when prepared to transmit signals, the method including the steps of:

(a) accepting, as a master signal transmission system, the participating signal transmission system which happens to generate its readiness signal at a point in time after the generation of readiness signals by all others of the participating signal transmission systems;

(b) synchronizing signal transmissions by all of the participating systems responsively to generating of the readiness signal bY the accepted master signal transmission system; and (c) effecting continuance of the synchronism between remaining of the sYstems despite inoperativeness, subsequentlY to such effecting of synchronous signal transmission, of the accepted master signal transmission system.

Figure 6:
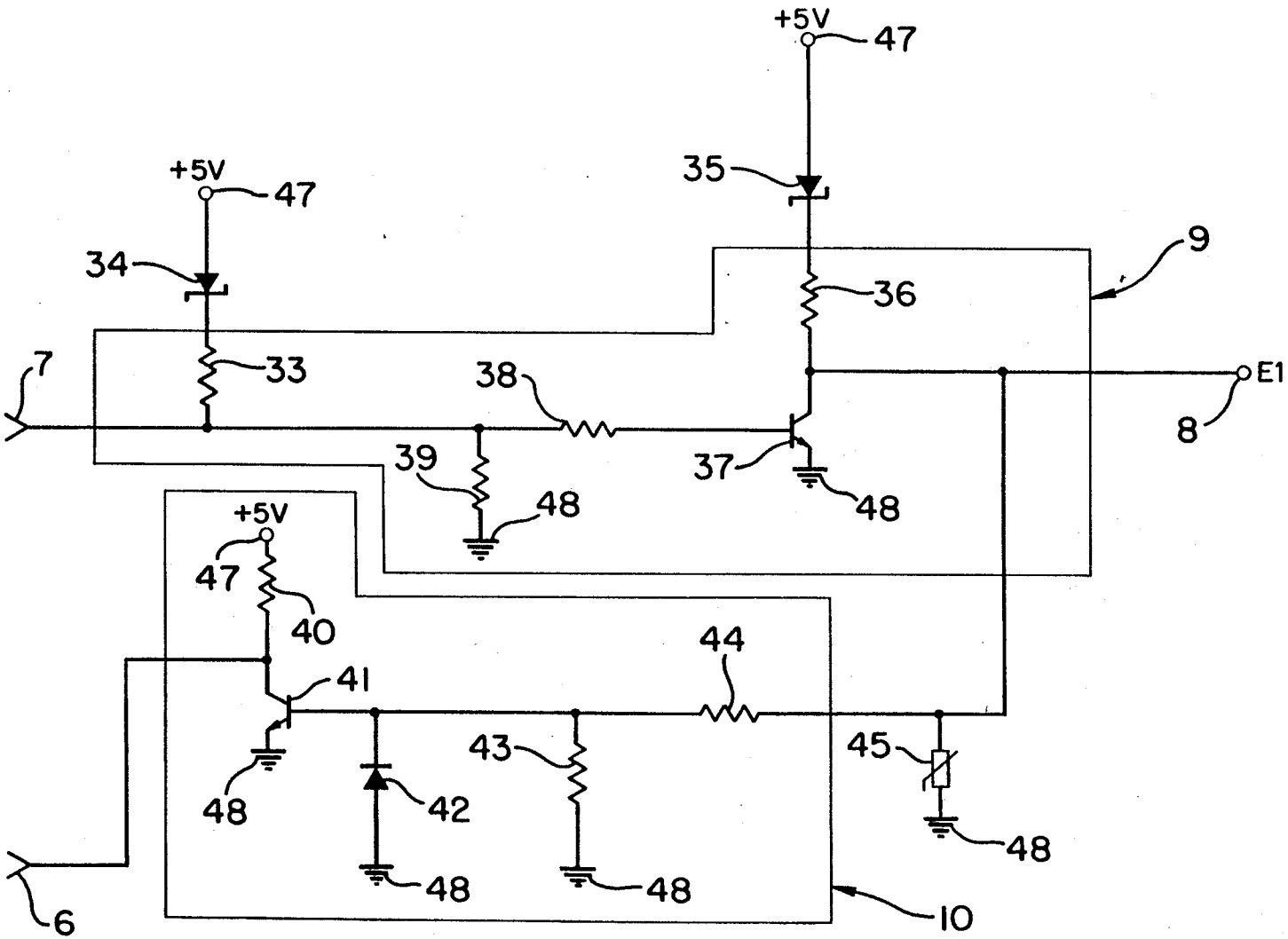
FIG. 6 is a detailed electrical schematic diagram of a synchronization buffer in accordance with the invention.

FIG. 6 is a schematic implementation of driver 9 and synchronization unit 10. Driver 9 comprises an NPN transistor 37 having an emitter, collector and base. The collector connects through a pull up resistor 36 to the cathode of a Schottky diode 35. The anode of diode 35 connects to a source voltage 47. The base connects through a base resistor 38 to line 7. The emitter is connected to ground 48. The collector also connects to terminal 8. Line 7 is biased by resistor 39 connecting to ground 48 and resistor 33 connecting through diode 34 to the voltage supply 47. Synchronizer unit 10 comprises a second NPN transistor 41 having a second emitter, second collector and a second base. The second base connects through a second base resistor 44 to the bidirectional I/O terminal 8 and connects through a pull down resistor 43 to a ground 48. The second emitter connects to ground 48. The second collector connects through a second pull up resistor 40 to the source voltage 47 and connects to the sync output 6. A diode 42 is connected from ground 48 to the base of the second transistor 41. A surge protection device 45 is connected between the terminal 8 and ground 48.

When the status output 7 is high (inactive), the transistor 48 is turned on and terminal 8 is pulled toward ground through the low impedance of the transistor's collector/emitter junction. When the status output is low (active), the transistor 48 is turned off and terminal 8 receives the supply voltage 47 through resistor 36. When multiple sync buffers have their terminals connected together by a companion line, the foregoing establishes that the companion line remains near ground until all system outputs are active.

A single EAS system used in a stand alone mode will operate properly as the status output is wrapped upon itself. For example, referring to FIG. 3, the status output 7 passes through the driving means 9 and returns through the sync means 10 to the sync output 6.

Various changes may evidently be introduced in the foregoing structure without departing from the invention. Thus, the particularly described and preferred embodiment is intended to be illustrative and not limiting of the invention. The true spirit and scope of the invention is set forth in the appended claims.

What is claimed is:

1. In combination, an electronic article surveillance system for disposition in an area to be subjected to such surveillance and control circuit means connected with said system, said system generating a readiness signal when prepared to effect electronic article surveillance and being thereafter responsive to an input signal to commence electronic article surveillance, said control circuit means being responsive to said readiness signal selectively to generate said input signal and being adapted to suppress generation of said input signal responsively to further input to said control circuit means indicative of the existence of a predetermined condition.

2. The invention claimed in claim 1 further including a second electronic article surveillance system for disposition in said area, said second article surveillance system likewise generating said readiness signal when prepared to effect electronic article surveillance, said control circuit means having facility for receiving said second system readiness signal, said predetermined condition being the absence of said second system readiness signal.

3. In combination, for effecting electronic article surveillance in an area:

(a) a first electronic article surveillance system for disposition in said area and first control circuit means connected with said first system, said first system generating a readiness signal when prepared to effect electronic article surveillance and being thereafter responsive to a first input signal to commence electronic article surveillance, and (b) a second electronic article surveillance system for disposition in said area and second control circuit means connected with said second system, said second system generating a readiness signal when prepared to effect electronic article surveillance and being thereafter responsive to a second input signal to commence electronic article surveillance, said first and second control circuit means being interconnected and operative respectively to simultaneously generate said first and second input signals selectively upon generation of both of said readiness signals and to suppress generation of both of said first and second input signals absent said generation of both of said readiness signals.

4. Apparatus for controlling the transmit cycle of an electronic article surveillance system, said system having an input terminal for receiving a transmit control signal and responsive thereto to commence transmission and an output terminal for generating a status output signal at an active logic level when in readiness to transmit and otherwise at an inactive logic level, said apparatus comprising:

(a) first circuit means having an input terminal for connection to said system output terminal and an output terminal, said first circuit means driving said output terminal thereof to a first logic level when said input terminal thereof receives an active logic level signal and to a second logic level when said input terminal thereof receives an inactive logic level signal;

(b) a bidirectional I/O terminal connected to said first circuit means output terminal; and (c) second circuit means having an output terminal for connection to said system input terminal and an input terminal connected to said bidirectional I/O terminal, said second circuit means supplying said transmit control signal to said system input terminal when said bidirectional I/O terminal is at said first logic level.

5. Apparatus for synchronizing the transmit cycles of a plurality of electronic article surveillance systems, each said system having an input terminal for receiving a transmit control signal and responsive thereto to commence transmission and an output terminal for generating a status output signal at an active logic level when in readiness to transmit and otherwise at an inactive logic level, said apparatus comprising:

(a) a plurality of first circuit means each having an input terminal for connection to a distinct one of said system output terminals and an output terminal, each said first circuit means driving said output terminal thereof to a first logic level when said input terminal thereof receives an active logic level signal and to a second logic level when said input terminal thereof receives an inactive logic level signal;

(b) a plurality of bidirectional I/O terminals each connected to a distinct one of said first circuit means output terminals, said bidirectional I/O terminals being connected to one another; and (c) a plurality of second circuit means each having an output terminal for connection to a distinct one of said system input terminals and an input terminal connected to a distinct one of said bidirectional I/O terminals, each said second circuit means supplying said transmit control signal to a distinct one of said system input terminals exclusively when said bidirectional I/O terminals are all at said first logic level.

6. In combination:

(a) a plurality of signal transmission systems in number n (n being an integer exceeding two), said systems generating respective system readiness signals when prepared to transmit signals; and (b) control circuit means connected with said systems for effecting synchronous signal transmission by said systems upon the occurrence of the last to be generated of said system readiness signals and for effecting continuance of said synchronism between remaining of said systems despite inoperativeness, subsequently to such effecting of synchronous signal transmission, of the system generating said last to be generated of said system readiness signals.

7. The invention claimed in claim 6 wherein each said system has an input terminal for receiving a control signal and responsive thereto to commence transmission and an output terminal for generating as said readiness signal a first logic level and otherwise generating a second logic level, said control circuit means comprising:

(1) n first circuit means each having an input terminal for connection to a distinct one of said systems for receiving the system readiness signal of said one system, and an output terminal, each said first circuit means driving said output terminal thereof to said first logic level when said input terminal thereof receives said first logic level and to said second logic level when said input terminal thereof receives said second logic level;

(2) n bidirectional I/O terminals each connected to a distinct one of said first circuit means output terminals, said bidirectional I/O terminals being connected to one another; and (3) n second circuit means each having an output terminal for connection to a distinct one of said systems and an input terminal connected to a distinct one of said bidirectional I/O terminals, each said second circuit means supplying said control signal to a distinct one of said systems exclusively when said bidirectional I/O terminals are all at said first logic level, such control signals effecting said synchronous transmission.

8. A method for synchronizing signal transmissions by a plurality of participating signal transmission systems, each adapted to generate a readiness signal when prepared to transmit signals, said method including the steps of:

(a) accepting, as a master signal transmission system, the participating signal transmission system which happens to generate its readiness signal at a point in time after the generation of readiness signals by all others of said participating signal transmission systems;

(b) synchronizing signal transmissions by all of said participating systems responsively to generating of said readiness signal by said accepted master signal transmission system; and (c) effecting continuance of said synchronism between remaining of said systems despite inoperativeness, subsequently to such effecting of synchronous signal transmission, of said accepted master signal transmission system.

* * * * *